US010106992B2

(12) United States Patent
Turner et al.

(10) Patent No.: US 10,106,992 B2
(45) Date of Patent: Oct. 23, 2018

(54) BRACKET FOR AN ACCESS PLATFORM

(71) Applicant: ODA SYSTEMS LTD, Kinross (GB)

(72) Inventors: Ross Turner, Kinross (GB); Donald Bisset, Kinross (GB)

(73) Assignee: ODA SYSTEMS LTD, Kinross (GB)

( * ) Notice: Subject to any disclaimer, the term of this patent is extended or adjusted under 35 U.S.C. 154(b) by 0 days.

(21) Appl. No.: 14/863,203

(22) Filed: Sep. 23, 2015

(65) Prior Publication Data

US 2017/0081865 A1 Mar. 23, 2017

(51) Int. Cl.
*E04G 7/02* (2006.01)
*E04G 3/30* (2006.01)

(52) U.S. Cl.
CPC *E04G 7/02* (2013.01); *E04G 3/30* (2013.01)

(58) Field of Classification Search
CPC E04G 7/02; E04G 7/307; E04G 7/308; E04G 1/14; E04G 5/14; E04G 5/16; E04G 3/30; B25H 1/06
See application file for complete search history.

(56) References Cited

U.S. PATENT DOCUMENTS 1,724,851 A * 8/1929 Romyak ..... E04G 5/062 248/240.3
1,843,268 A * 2/1932 Burkholder ..... E04G 5/06 248/240.3
1,848,085 A * 3/1932 Eisenschmidt ..... E04G 7/02 249/219.1
D177,888 S * 5/1956 Wambach ..... D25/68
3,036,657 A * 5/1962 Ladue ..... A47B 13/021 182/224
3,467,418 A * 9/1969 Redditt ..... E04G 5/04 182/229
3,938,290 A * 2/1976 Wyatt ..... E04G 1/06 182/186.8
D256,663 S * 9/1980 Gilb ..... D8/354
4,238,001 A * 12/1980 Alexander ..... B25H 1/06 16/263
4,338,040 A 7/1982 Hawkins
4,413,707 A * 11/1983 Lienhard, Sr. ..... E04G 3/30 182/130
4,536,102 A 8/1985 Doyle
5,516,245 A * 5/1996 Cassidy ..... B60P 7/15 403/261

(Continued)

FOREIGN PATENT DOCUMENTS

CA 2771466 A1 * 9/2013 ..... B25H 1/06
CA 2771466 A1 * 9/2013 ..... B25H 1/06

(Continued)

*Primary Examiner* — Katherine W Mitchell
*Assistant Examiner* — Candace L Bradford
(74) *Attorney, Agent, or Firm* — Liu & Liu

(57) ABSTRACT

The present invention relates to a bracket 22 for an access platform. The bracket 22 for an access platform comprises a main body 42 defining a channel configured to receive and provide a close fit around an elongate member 16 of the access platform. The bracket for an access platform further comprises first and second connection arrangements 46, 48 mechanically coupled to the main body 42 and extending from oppositely directed sides of the main body. Each connection arrangement is configured to mechanically couple to a further elongate member 50, 52 of the access platform.

20 Claims, 5 Drawing Sheets

(56) References Cited

U.S. PATENT DOCUMENTS

| | | | | | |
|---|---|---|---|---|---|
| D492,889 | S * | 7/2004 | Craine | D8/354 | |
| 7,766,576 | B2 * | 8/2010 | Connell | A01B 51/00 | 403/399 |
| 8,544,229 | B2 * | 10/2013 | Kilgore | E04F 15/02044 | 52/177 |
| 9,321,169 | B1 * | 4/2016 | Satur | F16B 9/023 | |
| D805,218 | S * | 12/2017 | Malone | D25/68 | |
| 2003/0178253 | A1 * | 9/2003 | Tatge | E04G 1/14 | 182/132 |
| 2008/0173788 | A1 * | 7/2008 | Brewka | E04G 11/10 | 249/189 |
| 2009/0223027 | A1 * | 9/2009 | Reznar | E04F 15/04 | 24/457 |
| 2013/0199024 | A1 * | 8/2013 | Gruenberg | F16M 13/02 | 29/525.08 |

FOREIGN PATENT DOCUMENTS

| | | | | | |
|---|---|---|---|---|---|
| DE | 654801 | | 12/1937 | | |
| DE | 806050 | | 6/1951 | | |
| DE | 102012216681 | A1 * | 3/2014 | E04G 5/12 | |
| DE | 102012216681 | A1 * | 3/2014 | E04G 5/12 | |
| EP | 0159250 | A1 * | 10/1985 | E04G 3/26 | |
| EP | 0159250 | A1 * | 10/1985 | E04G 3/26 | |
| EP | 1233122 | | 8/2002 | | |
| EP | 1544478 | | 6/2005 | | |
| EP | 2253764 | A2 * | 11/2010 | E01D 6/00 | |
| EP | 2253764 | A2 * | 11/2010 | E01D 6/00 | |
| FR | 2866043 | A1 * | 8/2005 | E04G 5/06 | |
| FR | 2866043 | A1 * | 8/2005 | E04G 5/06 | |
| FR | 2944073 | | 10/2010 | | |
| GB | 765360 | A * | 1/1957 | E04G 7/307 | |
| GB | 765360 | A * | 1/1957 | E04G 7/307 | |
| GB | 1141020 | | 1/1969 | | |
| GB | 1286445 | | 8/1972 | | |
| GB | 1322498 | A * | 7/1973 | E04G 7/308 | |
| GB | 1322498 | A * | 7/1973 | E04G 7/308 | |
| GB | 2226077 | | 6/1990 | | |
| JP | 2001020517 | A * | 1/2001 | | |
| JP | 2001020517 | A * | 1/2001 | | |
| JP | 2009108872 | | 5/2009 | | |
| JP | 2011127283 | A * | 6/2011 | | |
| JP | 2011127283 | A * | 6/2011 | | |
| WO | WO 0175248 | A1 * | 10/2001 | E04G 1/14 | |
| WO | WO-0175248 | A1 * | 10/2001 | E04G 1/14 | |
| WO | WO 2009123567 | A2 * | 10/2009 | E04G 7/307 | |
| WO | WO-2009123567 | A2 * | 10/2009 | E04G 7/307 | |

* cited by examiner

BRACKET FOR AN ACCESS PLATFORM

FIELD OF THE INVENTION

The present invention relates to a bracket for an access platform and in particular but not exclusively for a modular access platform. The present invention also relates to a frame for an access platform and in particular but not exclusively for a modular access platform, the frame comprising at least one bracket and plural elongate members. The present invention further relates to an access platform and in particular but not exclusively a modular access platform comprising at least one bracket.

BACKGROUND ART

Suspended access platforms are known. A typical suspended access platform comprises horizontally and vertically extending tubular members which are mechanically coupled to each other such that they extend orthogonally to each other to form a frame of appropriate length and width. Cross braces which extend diagonally between spaced apart horizontally extending tubular members are often used to increase rigidity. Decking is then laid on the thus formed frame to provide a support surface from which work may be done.

Double couplers are widely used to connect two orthogonally extending tubular members to each other. A double coupler comprises first and second clamps which are each configured to clamp around a different one of two tubular members with the apertures defined by the first and second clamps when closed being oriented orthogonally to each other. A double coupler is therefore operative as a bracket to support one tubular member on another tubular member. Joining a main tubular member which extends along the length of an access platform to first and second tubular members which extend in opposite directions across the width of the access platform therefore involves using a first double coupler to connect the main tubular member to the first tubular member and a second double coupler to connect the main tubular member to the second tubular member with the first and second double couplers being clamped at locations which are spaced apart from each other by a small distance along the main tubular member.

The present inventors have recognised that the above described approach of using the like of double couplers as brackets to join and support tubular members has disadvantages. The present invention has been devised in the light of the inventors' appreciation of such shortcomings. It is therefore an object for the present invention to provide an improved bracket for a modular access platform. It is a further object for the present invention to provide a frame for a modular access platform, the frame comprising at least one improved bracket and plural elongate members. It is a yet further object for the present invention to provide a modular access platform comprising at least one improved bracket.

STATEMENT OF INVENTION

According to a first aspect of the present invention there is provided a bracket for an access platform, the bracket comprising:

- a main body defining a channel configured to receive and provide a close fit around an elongate member of an access platform; and
- first and second connection arrangements mechanically coupled to the main body and extending from oppositely directed sides of the main body, each connection arrangement being configured to mechanically couple to a further elongate member of the access platform.

The bracket is brought into use by, for example, receiving an elongate member, such as a scaffolding tube, in the channel defined by the main body. The channel is configured such that it is a close fit around the elongate member. First and second connection arrangements are mechanically coupled to the main body and extend from oppositely directed sides of the main body. Then a first further elongate member, such as further scaffolding tube, is mechanically coupled to the first connection arrangement and a second further elongate member is mechanically coupled to the second connection arrangement such that the first and second further elongate members extend from oppositely directed sides of the main body. The bracket may be configured such that the first and second further elongate members extend away from the elongate member received in the channel of the main body. The bracket may thus be operative to support the first and second further elongate members from the elongate member received in the channel of the main body. In contrast with the known double coupler described above, only one bracket according to the invention is required to couple three elongate members to each other.

Plural brackets according to the invention may be used in this fashion to form an access platform. The bracket is therefore configured to form part of an access platform and more specifically a suspended access platform. The bracket may be for a temporary access platform. Temporary suspended access platforms are often used where installation or maintenance operations are being carried out at a location where it is impracticable to provide ground supported access platforms. The access platform may be modular to thereby provide for ease of configuration of the access platform for the application to hand and perhaps also for ease of installation of the access platform before work commences and of removal of the access platform when work is complete.

The bracket may be configured such that the first and second connection arrangements are aligned with each other. The first and second connection arrangements may therefore extend from corresponding locations on oppositely directed sides of the main body. In use, proximal ends of elongate members that are mechanically coupled to the first and second connection arrangements may be in registration with each other. The bracket may be configured such that, in use, longitudinal axes of the first and second further elongate members are aligned.

The bracket may be configured such that, in use, at least one of the first and second further elongate members may extend orthogonally of an elongate member received in the channel of the main body. More specifically both of the first and second further elongate members may extend orthogonally of an elongate member received in the channel of the main body. Therefore the first further elongate member may be orthogonal to the elongate member received in the channel and the second further elongate member may be orthogonal to the elongate member received in the channel.

The channel defined by the main body may be an open channel. More specifically the channel may be open at a side opposite a base of the channel. The channel may be open at each end of the channel. When an elongate member is received in the channel the channel may therefore straddle the elongate member. The channel may be of substantially rectangular cross-section. The channel may be configured to receive and provide a close fit around a standard scaffolding tube such as tube of 48.3 mm outer diameter.

The main body may comprise first and second main plates which are spaced apart from each other. The first and second main plates may be of substantially the same shape. An edge of each of the first and second main plates may be joined to each other by a base member. The first and second main plates may define opposing surfaces which are substantially parallel to each other. The base member and the first and second main plates may thus define the channel. The base member and the first and second main plates may be integrally formed. More specifically the base member and the first and second main plates may be formed by shaping a sheet of metal. The main body may be formed from steel, such as structural steel and more specifically S700 grade steel. The main body may be configured, such as in respect of at least one of its shape, dimensions and material, such that distal ends of the first and second main plates flex. Flexing of the first and second main plates may provide for a tight fit of the channel around the elongate member received in the channel.

The first and second main plates may extend further along the direction of the channel than the base member. More specifically the first and second main plates may extend further than the base member at each of two oppositely directed ends of the base member. The first and second main plates may extend further than the base member at each of two oppositely directed ends of the base member by substantially a same amount. Where the first and second main plates are of substantially the same shape, the main body may be substantially symmetrical about a plane which extends orthogonal to the channel half way along the base member. The base member may be generally and more specifically substantially square when looking into the channel towards the base member. Each of the first and second main plates may be configured such that an edge of the main plate which extends beyond the base member and which is oriented towards the channel defining surface of the base member may be spaced apart from the channel defining surface of the base member in a depth-wise direction of the channel. A part of each of the first and second main plates which joins to the base member may therefore be higher than a part of the main plate which extends beyond the base member. Configuring the main plates in this fashion may save on material used to form the main plates.

Each of the first and second main plates may define first and second apertures which are spaced apart from each other along the direction of the channel. The first and second apertures may be spaced apart from each other by a distance greater than an outer diameter of an elongate member such as a standard scaffolding tube. The bracket may therefore be secured to an elongate member such that the bracket extends across another member, such as a bracing member, which extends from the elongate member and such that the bracket can be secured to the elongate member on opposite sides of the other member. The first apertures of the first and second main plates may be in registration with each other and the second apertures of the first and second main plates may be in registration with each other. The first apertures may therefore cooperate with each other and the second apertures may cooperate with each other in securing the main body to an elongate member received in the channel.

The first apertures may be disposed towards a first end of the main plates and the second apertures may be disposed towards a second, opposite end of the main plates. The first and second apertures may be disposed towards a distal edge of the main plates and the main plates may be of sufficient height that the base member and the apertures are on opposite sides of an elongate member such as a standard scaffolding tube. The bracket may further comprise first and second securing arrangements, such as a nut and bolt arrangement. The first securing arrangement may mechanically couple with the first apertures in the first and second main plates such that, for example, an elongate member in the channel is held between the base member and the first securing arrangement. Likewise, the second securing arrangement may mechanically couple with the second apertures in the first and second main plates such that, for example, an elongate member in the channel is held between the base member and the second securing arrangement.

The base member may define a base aperture. The base aperture may be located generally and more specifically substantially centrally in the base member. The base aperture may in cooperation with a securing arrangement, such as a nut and bolt arrangement, provide for attachment of a decking component to the base member. Decking may thus be attached to a frame comprising at least one bracket to thereby form a surface from which work may be done.

The first and second connection arrangements may be rigidly coupled to the main body. The first and second connection arrangements may be formed separately from the main body and then coupled to the main body, for example, by welding.

Each of the first and second connection arrangements may define a recess for receiving a further elongate member. The recess may be defined in part by opposing surfaces of a connection arrangement. The opposing surfaces may be sides of the recess. The recess may be further defined by an exterior surface of the main body from which the connection arrangement extends. The exterior surface may be a base of the recess. A connection arrangement may comprise first and second spaced apart connector plates. The first and second connector plates may be spaced apart by a distance sufficient to admit an elongate member, such as a standard scaffolding tube, therebetween. The first and second connector plates may be of substantially a same shape. The first and second connector plates may be aligned with each other. Each of the first and second connector plates may have the form of lugs which abut at one end against the main body and extend from the main body.

A connector arrangement is configured to mechanically couple to a further elongate member, such as a standard scaffolding tube. Where the connector arrangement comprises first and second connector plates, each of the first and second connector plates may define a first connector aperture with the first connector apertures being in registration with each other. The first connector apertures may be operative in cooperation with a securing arrangement, such as a nut and bolt arrangement, to secure the connector arrangement to an elongate member such as by way of an aperture formed in the elongate member which is in registration with the first connector apertures. Each of the first and second connector plates may define a second connector aperture spaced apart from the first connector aperture either towards or away from the main body, with the second connector apertures being in registration with each other. The second connector apertures may be operative in cooperation with a securing arrangement to attach the elongate member to the connector arrangement more securely. In a particular application, an aperture may be formed towards an end of an elongate member at a location and the elongate member may be attached to the first and second connector plates by way of the aperture formed in elongate member such that the elongate member is pivotable in relation to the bracket about an axis defined by the aperture formed in the elongate member. Then the elongate member may be secured against pivoting in relation to the bracket by way of a second aperture which is formed in the elongate member at a location spaced along the elongate member from the first aperture and which cooperates with the second pair of apertures formed in the first and second connector plates.

The first and second connection arrangements may comprise a first integrally formed arrangement and a second integrally formed arrangement. Each connection arrangement may be formed from steel, such as structural steel and more specifically S700 grade steel. Each of the first and second integrally formed arrangements may be spaced apart from each other and may be configured when attached to the main body to extend from oppositely directed sides of the main body to thereby constitute the first and second connection arrangements. Each integrally formed arrangement may be formed from sheet metal. Each integrally formed arrangement may therefore have the form of a plate. The first and second integrally formed arrangements may be of substantially the same shape. Each integrally formed arrangement may comprise first and second lugs which are spaced apart from each other and joined by a bridge element, the first and second lugs and the bridge element all lying in the same plane. A main body recess may be defined by opposing edges of the first and second lugs and an edge of the bridge element. The main body recess may be configured to receive the main body. More specifically and where the main body comprises a base member, the main body recess defining edge of the bridge element may abut against the base member. The main body recess defining edge of the bridge element may abut against the surface of the base member oriented away from the channel defined by the main body. Such a configuration may transmit forces exerted on one connection arrangement to the other connection arrangement and thereby provide for distribution and balancing of forces.

Each of the first and the second integrally formed arrangements and the main body may comprise inter-engaging profiles which cooperate to restrict movement of the integrally formed arrangement relative to the main body in at least one of: the direction of the channel; and a direction orthogonal to the channel and a depth-wise direction of the channel. The integrally formed arrangement may comprise a protrusion, for example on the bridge element, and the main body may comprise a recess, for example in the base member, the protrusion being configured to be received at least in part in the recess.

According to a second aspect of the present invention there is provided a frame for an access platform, the frame comprising at least one bracket according to the first aspect of the present invention and at least three elongate members which are coupled to each other by way of the at least one bracket.

Embodiments of the second aspect of the present invention may comprise one or more features of the first aspect of the present invention.

According to a third aspect of the present invention there is provided an access platform comprising plural brackets according to the first aspect of the present invention and plural elongate members, each of the plural brackets being operative to couple three of the plural elongate members to each other. As described above, the access platform may be a suspended access platform. Alternatively or in addition, the access platform may be a modular access platform.

Embodiments of the third aspect of the present invention may comprise one or more features of the first aspect of the present invention.

According to a further aspect of the present invention there is provided a bracket for an access platform, the bracket comprising: a main body defining a channel configured to receive an elongate member; and at least one connection arrangement mechanically coupled to the main body and extending from a side of the main body, the connection arrangement being configured to mechanically couple to a further elongate member. Embodiments of the further aspect of the present invention may comprise one or more features of any previous aspect of the present invention.

BRIEF DESCRIPTION OF DRAWINGS

Further features and advantages of the present invention will become apparent from the following specific description, which is given by way of example only and with reference to the accompanying drawings, in which.

DESCRIPTION OF EMBODIMENTS

Figure 1:
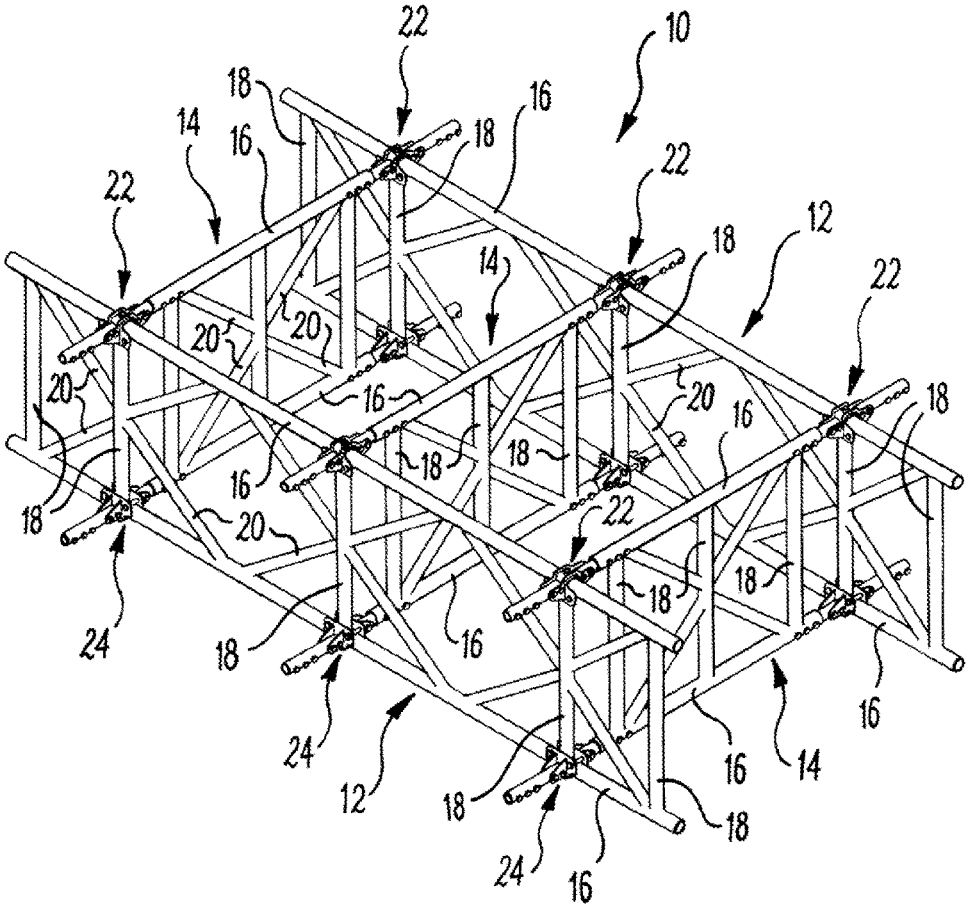
FIG. 1 shows a frame for an access platform comprising plural brackets according to the invention.

A frame 10 for an access platform is shown in FIG. 1. The frame 10 for the access platform is of a form that is suspended by suspension brackets (not shown) which are mechanically coupled at spaced apart locations to the frame 10. The frame 10 comprises five planar frames. Two of the planar frames 12 are spaced apart from each other and extend lengthwise along the frame 10. The remaining three planar frames 14 extend width-wise between the two lengthwise extending planar frames 12. One of the width-wise extending planar frames 14 is located towards one end of the frame 10. A second width-wise extending planar frame 14 is located towards the opposite end of the frame 10. The third width-wise extending planar frame 14 is located half way along the frame 10. The access platform further comprises decking components (not shown) which are attached, as described further below, to the top of the frame 10 shown in FIG. 1 to form a planar surface from which work can be done.

Each of the five planar frames 12, 14 comprises two spaced apart and horizontally extending tubes 16 (which constitute elongate members) and plural vertically extending tubes 18 (which constitute elongate members) which extend between the horizontally extending tubes 16. Each of the five planar frames 12, 14 further comprises cross braces 20 which extend diagonally between horizontally and vertically extending tubes to thereby increase the rigidity of the planar frame. The horizontally and vertically extending tubes 16, 18 are of standard scaffolding form. In the present embodiment the horizontally and vertically extending tubes 16, 18 have an outer diameter of 48.3 mm and are formed of either aluminium or stainless steel. The horizontally and vertically extending tubes 16, 18 and the cross braces 20 of each planar frame 12, 14 are connected rigidly to each other by welding. Each width-wise extending planar frame 14 is connected at each of two ends to a lengthwise extending planar frame 12 by a pair of first and second brackets 22, 24.

The first and second brackets 22, 24 are of the same form and function. The first bracket 22 in a pair connects the upper horizontally extending tube 16 of the width-wise extending planar frame 14 to the upper horizontally extending tube 16 of the lengthwise extending planar frame 12 and the second bracket 24 in a pair connects the lower horizontally extending tube 16 of the width-wise extending planar frame 14 to the lower horizontally extending tube 16 of the lengthwise extending planar frame 12. Although not shown in FIG. 1 and as will become apparent from the following description, each bracket 22, 24 is configured to connect to a horizontally extending tube of a further width-wise extending planar frame (not shown) further to the horizontally extending tube of the width-wise extending planar frame 14 shown in FIG. 1. A wider frame than the frame 10 shown in FIG. 1 may thus be formed wherein horizontally extending tubes of two different width-wise extending planar frames are connected to and extend from opposite sides of a bracket 22, 24.

Figure 2:
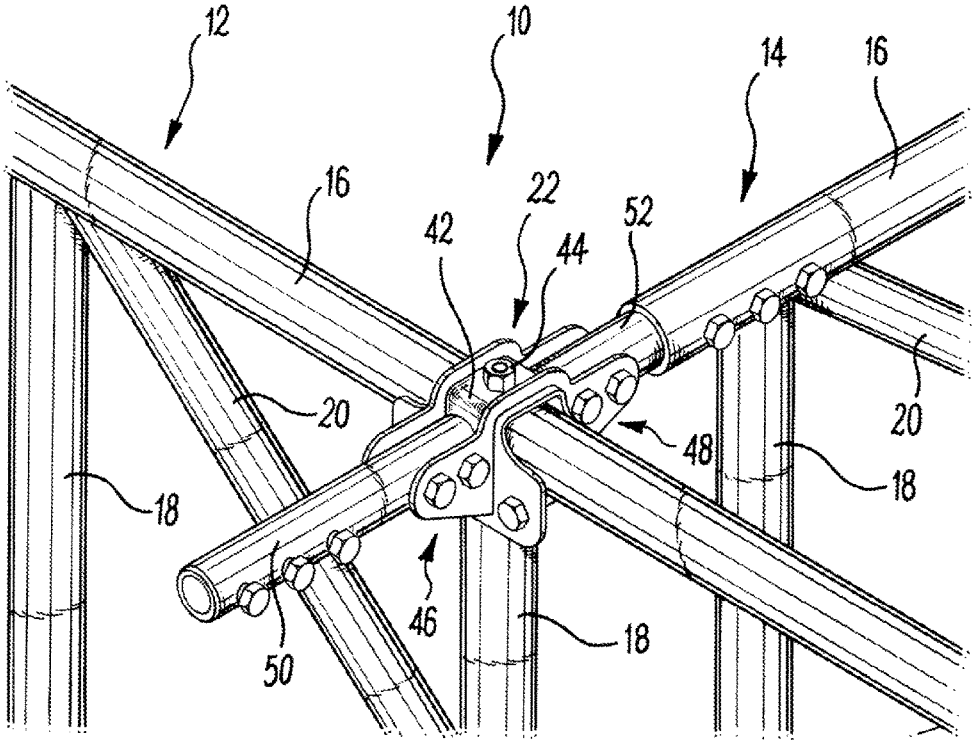
FIG. 2 is a partial view of the frame of FIG. 1 showing one bracket in detail.
Figure 3A:
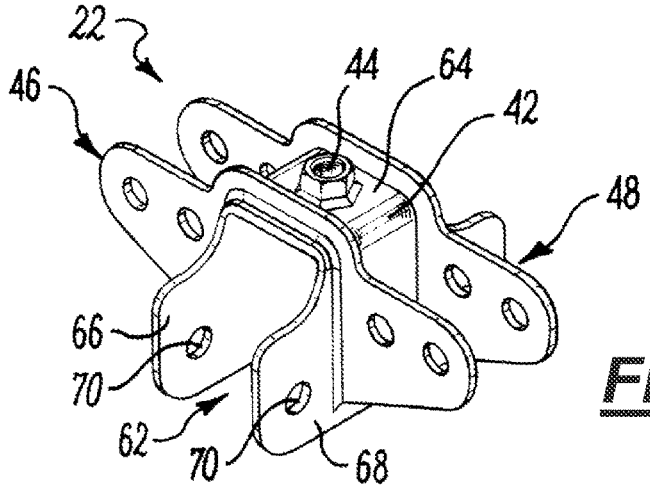
FIG. 3A is a perspective view of the bracket of FIG. 2.
Figure 3B:
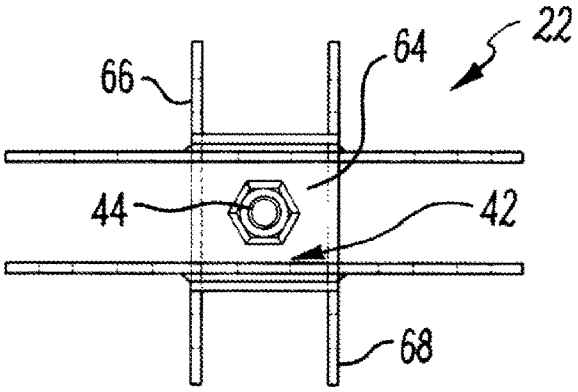
FIG. 3B is a plan view of the bracket of FIG. 3A.
Figure 3C:
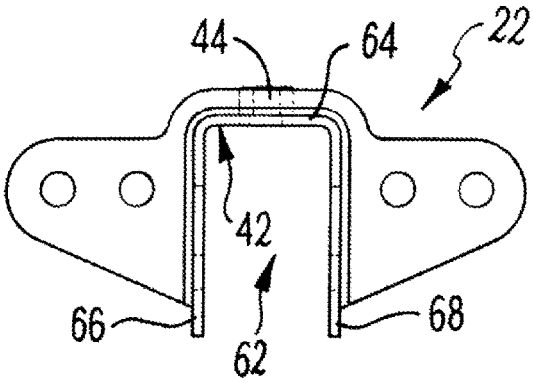
FIG. 3C is a view from one end of the bracket of FIG. 3A.
Figure 3D:
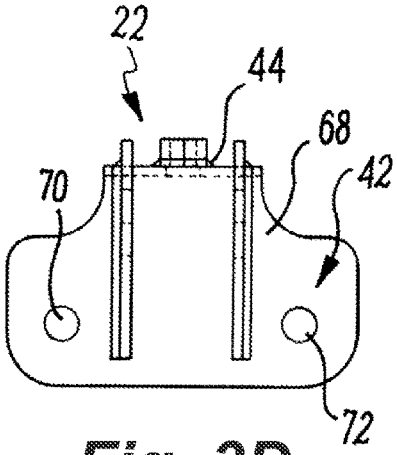
FIG. 3D is a view from one side of the bracket of FIG. 3A.
Figure 4A:
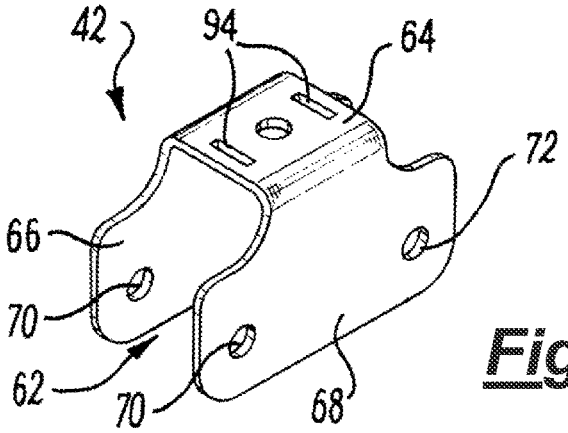
FIG. 4A is a perspective view of the main body of the bracket of FIG. 2.
Figure 4B:
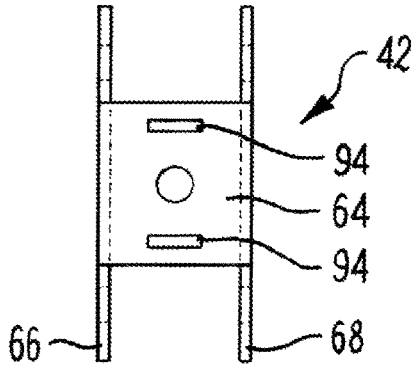
FIG. 4B is a plan view of the main body of FIG. 4A.
Figure 4C:
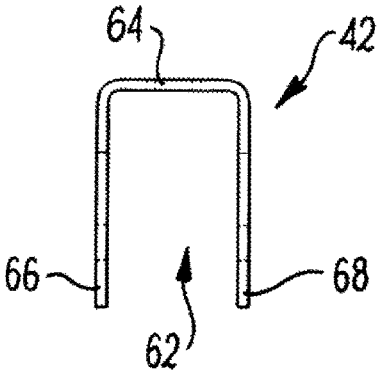
FIG. 4C is a view from one end of the main body of FIG. 4A.
Figure 4D:
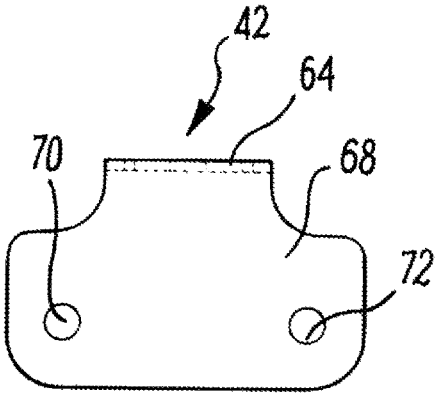
FIG. 4D is a view from one side of the main body of FIG. 4A.
Figure 5A:
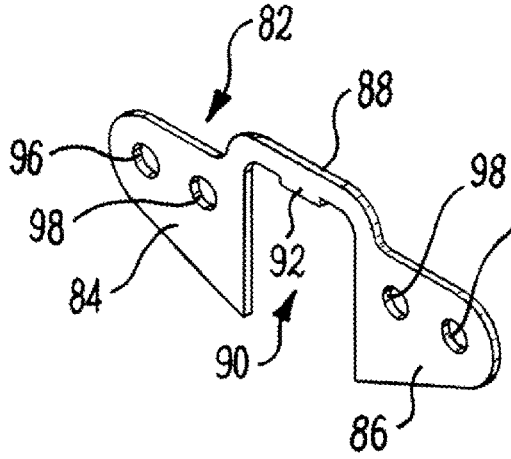
FIG. 5A is a perspective view of a connection plate of the bracket of FIG. 2.
Figure 5B:
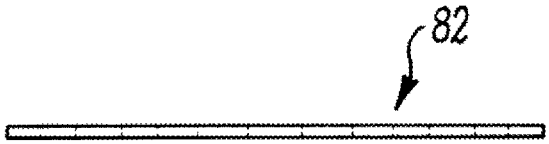
FIG. 5B is a plan view of the connection plate of FIG. 5A.
Figure 5C:
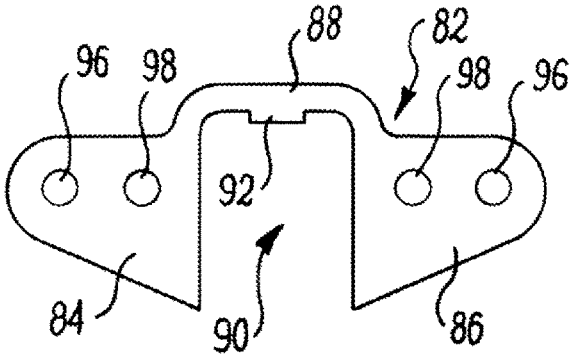
FIG. 5C is a view from one end of the connection plate of FIG. 5A.
Figure 5D:
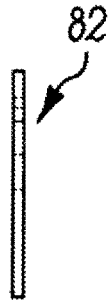
FIG. 5D is a view from one side of the connection plate of FIG. 5A.

A partial view of the frame 10 of FIG. 1 is shown in FIG. 2. The partial view shows one bracket 22 in detail. Components of FIG. 2 in common with FIG. 1 are designated with like reference numerals. The reader's attention is therefore directed to FIG. 1 for a description of such common components. As can be seen from FIG. 2, the bracket 22 comprises a main body 42 which defines a channel that is configured to receive and provide a close fit around the upper horizontally extending tube 16 of the lengthwise extending planar frame 12. The main body 42 comprises a nut 44 which is attached to the top of the main body 42. The nut 44 along with nuts of other brackets provide for securing of decking components to the top of the frame 10. The main body 42 is described further below with reference to FIGS. 3A to 3D. First and second connection arrangements 46, 48 extend from oppositely directed sides of the main body 42 in directions orthogonal to the channel defined by the main body 42 and hence orthogonal to the upper horizontally extending tube 16 of the lengthwise extending planar frame 12. The first and second connection arrangements 46, 48 are described further below with reference to FIGS. 3A to 3D. First and second tubular struts 50, 52 of moderate length are fastened at one end by way of two nut and bolt arrangements to a respective one of the first and second connection arrangements 46, 48. As can be seen in FIG. 2, the distal end of the second tubular strut 52 is received inside an end of the horizontally extending tube 16 of the width-wise extending planar frame 14 and secured to the end of the horizontally extending tube 16 by way of three nut and bolt arrangements which are received in aligned apertures formed in and spaced apart along the distal end of the second tubular strut 52 and the end of the horizontally extending tube. Although not shown in FIG. 2 and as described above with reference to FIG. 1, a horizontally extending tube of a width-wise extending planar frame is attached in the same fashion to the first tubular strut 50.

FIGS. 3A to 3D respectively provide a perspective view, a plan view, a view from one end and a view from one side of the bracket of FIG. 2. Components of FIGS. 3A to 3D in common with FIG. 2 are designated with like reference numerals. The bracket 22 comprises a main body 42, a first connection arrangement 46 and a second connection arrangement 48. The first and second connection arrangements 46, 48 extend from corresponding locations on oppositely directed sides of the main body 42 in directions orthogonal to the channel defined by the main body 42. As can be seen from FIGS. 3A and 3C, the channel 62 defined by the main body 42 is open at a side opposite a base of the channel and open at each end of the channel. Furthermore the channel 62 is of substantially rectangular cross-section. The width of the channel is 48.9 mm whereby the channel is configured to receive and provide a close fit around a standard scaffolding tube of 48.3 mm outer diameter.

The main body will now be described in more detail with reference to FIGS. 4A to 4D as well as FIGS. 3A to 3D. FIGS. 4A to 4D respectively provide a perspective view, a plan view, a view from one end and a view from one side of the perspective view of the main body of the bracket shown in FIGS. 3A to 3D. The main body 42 comprises a base member 64, a first main plate 66 and a second main plate 68. The first and second main plates 66, 68 are of substantially the same shape and spaced apart from each other to define the channel 62 therebetween. An edge of each of the first and second main plates 66, 68 are joined to each other by the base member 64 whereby the base member defines the base of the channel 62. The base member 64 and the first and second main plates 66, 68 are formed by shaping a sheet of S700 grade steel. Furthermore the main body 42 is configured in respect of its thickness of 4 mm such that distal ends of the first and second main plates 66, 68 flex to a small extent. Flexing of the first and second main plates provides for a tight fit of the channel around the elongate member received in the channel when the nut and bolt arrangements described below are tightened. The base member 64 is substantially square when looking into the channel towards the base member with a length of 60 mm along the channel and a width of 56.9 mm between the first and second main plates.

The first and second main plates 66, 68 extend further along the direction of the channel 62 than the base member 64 by a same amount of 44.35 mm at each of two oppositely directed ends of the base member. As one progresses along each of the first and second main plates 66, 68 in either direction away from the base member 64, an edge of the main plate drops away from the base member whereby the part of the main plate that extends beyond the base member is narrower than the part of the main plate that is joined to the base member. The opposing, i.e. bottom, edge of the main plate is straight between near the distal ends of the main plate. The distal ends of the main plate are rounded. Each of the first and second main plates 66, 68 is 148.7 mm long and 84 mm high at the part of the main plate that is joined to the base member 64. The parts of the main plate that extend beyond the base member 64 are each 45.7 mm high.

Each of the first and second main plates 66, 68 define first and second apertures 70, 72 which are spaced apart from each other along the direction of the channel 62 by 100 mm. The first apertures 70 are therefore disposed towards a first end of the main plates and the second apertures 72 are disposed towards a second, opposite end of the main plates. The first apertures 70 of the first and second main plates 66, 68 are in registration with each other and the second apertures 72 of the first and second main plates 66, 68 are in registration with each other. A spacing of 100 mm between the first and second apertures 70, 72 allows the bracket 22 to be secured to a tube in a frame such that the channel spans a vertically extending tube and perhaps also bracing members which extend from the horizontally extending tube and such that the bracket can be secured to the tube on opposite sides of the vertically extending tube and perhaps also bracing members. As described above, as one progresses along each of the first and second main plates 66, 68 in either direction away from the base member 64, an edge of the main plate drops away from the base member. A centre of each of the first and second apertures 70, 72 is therefore spaced apart from the plane defined by the base member 64 by 61.15 mm whereby the base member and the apertures 70, 72 are on opposite sides of a standard scaffolding tube having an outer diameter of 48.3 mm when the scaffolding tube is received in the channel 62. As described above when a tube is received in the channel 62 the main body is attached to the tube by way of nut and bolt arrangements which are received in the first and second apertures 70, 72 of the first and second main plates 66, 68.

The first and second connection arrangements of the main body will now be described in more detail with reference to FIGS. 5A to 5D as well as FIGS. 3A to 3D. FIGS. 5A to 5D respectively provide a perspective view, a plan view, a view from one end and a view from one side of the perspective view of a connection plate which forms in part the first and second connection arrangements of FIGS. 3A to 3D. As can be seen from FIGS. 3A to 3D, each of the first and second connection arrangements 46, 48 defines a recess for receiving an end of a scaffolding tube or an end of one of the tubular struts 50, 52 shown in FIG. 2. The sides of the recess are defined by opposing surfaces of a connection arrangement 46, 48 with the base of the recess being defined by an exterior surface of the main body 42 from which the connection arrangement extends. The first and second connection arrangements 46, 48 are constituted by first and second spaced connector plates 82 (which each constitute an integrally formed arrangement) which are mounted on the main body 42 such that they are spaced apart from each other. The first and second connector plates 82 are of substantially a same shape and align with each other when mounted on the main body 42.

Each of the first and second connector plates 82 is formed from S700 grade steel. Each of the first and second connector plates 82 is configured when mounted on the main body to extend from oppositely directed sides of the main body 42 whereby both connector plates 82 constitute the first and second connection arrangements 46, 48. Each of the first and second connector plates 82 comprises first and second lugs 84, 86 which are spaced apart from each other and joined by a bridge element 88 with the first and second lugs and the bridge element all lying in the same plane. A main body recess 90 is defined by opposing edges of the first and second lugs 84, 86 and an edge of the bridge element 88. The main body recess 90 is configured to receive the main body 42 such that the main body recess defining edge of the bridge element 88 abuts against the base member 64.

Each of the first and second connector plates 82 defines a protrusion 92 on the edge of the bridge element 88 that defines the main body recess 90 whereby the protrusion extends into the main body recess. As can be seen from FIGS. 4A and 4B two recesses 94 are defined in the base member 64 of the main body 42 at locations spaced apart along the channel 62. The dimensions of each recess 94 correspond to the dimensions of the protrusions 92 defined by the first and second connector plates 82. Each of the first and second connector plates 82 are mounted on the main body 42 such that the main body is received in the main body recess 90 and the connector plate protrusion 92 is received in one of the two recesses 94 defined in the base member 64. Then the first and second connector plates 82 are attached securely to the main body 42 by welding. The inter-engagement of protrusions 92 and recesses 94 restricts movement of the first and second connector plates 82 relative to the main body in the direction of the channel 62 and a direction across the channel.

Each of the first and second connector plates 82 defines first and second connector apertures 96, 98 on each of the first and second lugs 84, 86. The first and second connector apertures 96, 98 are spaced apart along a direction away from the main body recess 90. When the first and second connector plates 82 are mounted on the main body 42, the first connector apertures 96 of the two plates are in registration and the second connector apertures 98 of the two plates are in registration. In use, an end of a scaffolding tube or an end of one of the tubular struts 50, 52 shown in FIG. 2, which has two apertures of a size and spacing corresponding to the first and second connector apertures 96, 98, is received between opposing lugs of the first and second connector plates 82. In a first form, when a nut and bolt arrangement is received in one of the two apertures in the scaffolding tube or tubular strut and in a pair of one of the first and second connector apertures 96, 98, the two apertures in the scaffolding tube or tubular strut are provided at locations such that the end of the tube or strut abuts against the side of the main body to thereby prevent rotation of the scaffolding tube or tubular strut about the bolt in relation to the main body. A second nut and bolt arrangement is then received in the other of the two apertures in the scaffolding tube or tubular strut and in a pair of the other of the first and second connector apertures 96, 98 to thereby attach the scaffolding tube or tubular strut to the bracket 22 more securely. In a second form, when a first nut and bolt arrangement is received in one of the two apertures in the scaffolding tube or tubular strut and in a pair of one of the first and second connector apertures 96, 98, the two apertures in the scaffolding tube or tubular strut are provided at locations such that the end of the tube or strut is spaced apart from the side of the main body to thereby allow rotation of the scaffolding tube or tubular strut about the first bolt in relation to the main body. When two or more brackets 22 according to the second form are employed, a frame 10 may be installed by assembling a frame sub-assembly in an upright position before lowering the assembled frame sub-assembly by rotation about the first bolts which couple plural scaffolding tubes or tubular struts to respective brackets. When the assembled frame sub-assembly is lowered such that it is in line with an already installed part of the frame 10, second nut and bolt arrangements are then each received in the other of the two apertures in a scaffolding tube or tubular strut and in a pair of the other of first and second connector apertures 96, 98 of a respective bracket to thereby secure against rotation about the first bolts.

The invention claimed is:

1. A bracket for an access platform, the bracket comprising:

a main body comprising a base member and first and second spaced apart plates, the base member and the first and second plates defining an open channel which is open opposite the base member and at each end of the base member, the open channel being configured to receive and provide a close fit around a tubular elongate member of an access platform;

a first connector plate which extends away from the first and second plates of the main body, with a first end of the first connector plate extended beyond the first plate and a second end of the first connector plate extended beyond the second plate, wherein the first connector plate spans the main body including the first and second plates between the first and second ends of the first connector plate; and a second connector plate which extends away from the first and second plates of the main body, with a first end of the second connector plate extended beyond the first plate and a second end of the second connector plate extended beyond the second plate, wherein the second connector plate spans the main body including the first and second plates between the first and second ends of the second connector plate, wherein the first and second connector plates are spaced apart from each other whereby the first end of the first connector plate and the first end of the second connector plate form a first recess therebetween for receiving a first further tubular elongate member and the second end of the first connector plate and the second end of the second connector plate form a second recess therebetween for receiving a second further tubular elongate member therebetween, and wherein each of the first and the second connector plates and the main body comprise inter-engaging profiles which cooperate to restrict movement of each of the first and the second connector plates relative to the main body in at least one of: a direction along the open channel; and a direction orthogonal to a direction along the open channel and a depth-wise direction of the open channel.

2. An access platform comprising:

a plurality of tubular elongate members;

a plurality of first further tubular elongate members;

a plurality of second further tubular elongate members; and a plurality of brackets, each bracket comprising:

a main body comprising a base member and first and second spaced apart plates, the base member and the first and second plates defining an open channel which is open opposite the base member and at each end of the base member, the open channel being configured to receive and provide a close fit around one of the plurality of tubular elongate members;

a first connector plate which extends away from the first and second plates of the main body, with a first end of the first connector plate extended beyond the first plate and a second end of the first connector plate extended beyond the second plate, wherein the first connector plate spans the main body including the first and second plates between the first and second ends of the first connector plate; and a second connector plate which extends away from the first and second plates of the main body, with a first end of the second connector plate extended beyond the first plate and a second end of the second connector plate extended beyond the second plate, wherein the second connector plate spans the main body including the first and second plates between the first and second ends of the second connector plate, wherein the first and second connector plates are spaced apart from each other whereby the first end of the first connector plate and the first end of the second connector plate form a first recess therebetween for receiving one of the plurality of first further tubular elongate members and the second end of the first connector plate and the second end of the second connector plate form a second recess therebetween for receiving one of the plurality of second further tubular elongate members therebetween, and wherein each bracket is operative to couple said one of the plurality of tubular elongate members, said one of the plurality of first further tubular elongate members and said one of the plurality of second further tubular elongate members to each other.

3. An access platform according to claim 2, configured as a suspended access platform.

4. A bracket for an access platform, the bracket comprising:

a main body comprising a base member and first and second spaced apart plates, the base member and the first and second plates defining an open channel which is open opposite the base member and at each end of the base member, the open channel being configured to receive and provide a close fit around a tubular elongate member of an access platform;

a first connector plate which extends away from the first and second plates of the main body, with a first end of the first connector plate extended beyond the first plate and a second end of the first connector plate extended beyond the second plate, wherein the first connector plate spans the main body including the first and second plates between the first and second ends of the first connector plate; and a second connector plate which extends away from the first and second plates of the main body, with a first end of the second connector plate extended beyond the first plate and a second end of the second connector plate extended beyond the second plate, wherein the second connector plate spans the main body including the first and second plates between the first and second ends of the second connector plate, wherein the first and second connector plates are spaced apart from each other whereby the first end of the first connector plate and the first end of the second connector plate form a first recess therebetween for receiving a first further tubular elongate member and the second end of the first connector plate and the second end of the second connector plate form a second recess therebetween for receiving a second further tubular elongate member therebetween, and wherein a bridge element between the first and second ends of each of the first and second connector plates defines a base of a connector plate recess, the main body being received in each connector plate recess such that the base member abuts against an edge of the bridge element.

5. A bracket according to claim 4 in which each of the first and second connector plates are non-integrally formed with the main body.

6. An access platform bracket comprising a bracket according to claim 4.

7. A bracket according to claim 4 in which the first and second plates each have a shape and said shapes are substantially the same and the main body is substantially symmetrical about a plane which extends orthogonal to the open channel half way along the base member.

8. A bracket according to claim 4 configured such that, in use, both of the first and second further tubular elongate members extend orthogonally of the tubular elongate member received in the open channel of the main body.

9. A bracket according to claim 4 in which each of the first and second connector plates are shaped such that the first end of the first connector plate and the first end of the second connector plate extend from the first plate at respective locations on the first plate to form the first recess and the second end of the first connector plate and the second end of the second connector plate extend from the second plate at respective locations on the second plate to form the second recess.

10. A bracket according to claim 9 in which the first plate defines a base of the first recess and the second plate defines a base of the second recess.

11. A bracket according to claim 4 in which each of the first and second connector plates abuts against the first plate and the second plate, thereby each of the first and second connector plates spans the main body including the first and second plates between the first and second ends of each of the first and second connector plates.

12. A bracket according to claim 4 in which each connector plate comprises first and second lugs spaced apart from each other and joined by the bridge element, wherein each connector plate recess is defined by opposing edges of the first and second lugs and the edge of the bridge element.

13. A bracket for an access platform according to claim 12, wherein the first recess is defined between the first plate, the first lug of the first connector plate and the first lug of the second connector plate without further defining boundary, and wherein the second recess is bound by the second plate, the second lug of the first connector plate and the second lug of the second connector plate without further defining boundary.

14. A bracket for an access platform according to claim 4 in which the first and second ends of the first connector plate extend in opposite directions that are each perpendicular to the first and second plates, and the first and second ends of the second connector plate extend in opposite directions that are each perpendicular to the first and second plates.

15. A bracket for an access platform according to claim 4, wherein the first and second connector plates are each substantially planar.

16. A bracket for an access platform, the bracket comprising:

a main body comprising a base member and first and second spaced apart plates, the base member and the first and second plates defining an open channel which is open opposite the base member and at each end of the base member, the open channel being configured to receive and provide a close fit around a tubular elongate member of an access platform;

a first connector plate which extends away from the first and second plates of the main body, with a first end of the first connector plate extended beyond the first plate and a second end of the first connector plate extended beyond the second plate, wherein the first connector plate spans the main body including the first and second plates between the first and second ends of the first connector plate; and a second connector plate which extends away from the first and second plates of the main body, with a first end of the second connector plate extended beyond the first plate and a second end of the second connector plate extended beyond the second plate, wherein the second connector plate spans the main body including the first and second plates between the first and second ends of the second connector plate, wherein the first and second connector plates are spaced apart from each other whereby the first end of the first connector plate and the first end of the second connector plate form a first recess therebetween for receiving a first further tubular elongate member and the second end of the first connector plate and the second end of the second connector plate form a second recess therebetween for receiving a second further tubular elongate member therebetween, and wherein the first and second connector plates are shaped such that each of the first and second recesses extends in a direction perpendicular to the first and second plates, wherein longitudinal axes of the tubular elongate member, the first further tubular elongate member and the second further tubular elongate member lie in substantially the same plane when the tubular elongate member is received in the channel, the first further tubular elongate member is received in the first recess and the second further tubular elongate member is received in the second recess.

17. A bracket according to claim 16 in which the first and second plates each have a shape and said shapes are substantially the same and the main body is substantially symmetrical about a plane which extends orthogonal to the open channel half way along the base member.

18. A bracket according to claim 16, configured as an access platform bracket.

19. A bracket according to claim 16 in which each of the first and second connector plates are non-integrally formed with the main body.

20. A bracket for an access platform according to claim 16, wherein the first and second connector plates are each substantially planar.

* * * * *